US007261341B2

(12) United States Patent
Fan

(10) Patent No.: US 7,261,341 B2
(45) Date of Patent: Aug. 28, 2007

(54) REVERSIBLE LATCH ASSEMBLY

(75) Inventor: Fang-Chang Fan, Jiayih (TW)

(73) Assignee: Eversafety Precision Industry (Tianjin) Co., Ltd. (CN)

( * ) Notice: Subject to any disclaimer, the term of this patent is extended or adjusted under 35 U.S.C. 154(b) by 141 days.

(21) Appl. No.: 10/957,996

(22) Filed: Oct. 4, 2004

(65) Prior Publication Data

US 2006/0071480 A1 Apr. 6, 2006

(51) Int. Cl.
*E05B 15/00* (2006.01)
*E05C 1/00* (2006.01)

(52) U.S. Cl. ..... 292/244; 292/1.5; 292/169; 292/333; 292/337

(58) Field of Classification Search ..... 292/244, 292/1.5, 169, 337, DIG. 53, DIG. 60, DIG. 64, 292/333; 70/224
See application file for complete search history.

(56) References Cited

U.S. PATENT DOCUMENTS 2,644,705 A * 7/1953 Hagstrom ..... 292/169.13
4,662,665 A * 5/1987 Lin ..... 292/167
4,687,239 A * 8/1987 Lin ..... 292/172
4,711,477 A * 12/1987 Fann et al. ..... 292/169.14
4,718,706 A * 1/1988 Fang ..... 292/1.5
4,729,585 A * 3/1988 Lin ..... 292/1.5
4,729,586 A * 3/1988 Fang ..... 292/337
4,736,973 A * 4/1988 Fang ..... 292/337
4,767,140 A * 8/1988 Lin ..... 292/337
4,840,412 A * 6/1989 Shen ..... 292/337
5,149,151 A * 9/1992 Shen ..... 292/1.5
5,342,101 A * 8/1994 Shih ..... 292/165
5,456,503 A * 10/1995 Russell, IV ..... 292/1.5
5,562,314 A * 10/1996 Wheatland et al. ..... 292/1.5
5,613,715 A * 3/1997 Kim ..... 292/1.5
6,186,562 B1 * 2/2001 Huang ..... 292/169
6,386,603 B1 * 5/2002 Huang ..... 292/337
6,443,503 B1 * 9/2002 Fan Lu et al. ..... 292/1.5
6,494,504 B1 * 12/2002 Fan ..... 292/1.5
6,536,816 B1 * 3/2003 Fan ..... 292/337
6,974,163 B2 * 12/2005 Peng et al. ..... 292/1.5

* cited by examiner

*Primary Examiner*—Carlos Lugo
(74) *Attorney, Agent, or Firm*—Jackson Walker, LLP

(57) ABSTRACT

A reversible latch assembly has a faceplate assembly, a latch bolt assembly, a bolt-releasing assembly, a guardian bolt assembly, a driver assembly and a casing assembly. The latch bolt assembly, the bolt-releasing assembly and the guardian bolt assembly are rotatably mounted inside the casing assembly and allow the latch assembly to be reversed and used in either a clockwise or counterclockwise opening door.

5 Claims, 9 Drawing Sheets

REVERSIBLE LATCH ASSEMBLY

BACKGROUND OF THE INVENTION

1. Field of the Invention

The present invention relates to a latch assembly, and more particularly to a reversible latch assembly that can be used with a door that opens in a clockwise or a counterclockwise direction.

2. Description of Related Art

Most doors are mounted pivotally in a doorframe in an opening in a wall and have a latch assembly. The doorframe for most conventional doors has two vertical doorjambs with the door pivotally attached to one doorjamb and the latch assembly engaging the other doorjamb when the door is closed. Such doors can be classified into two groups according to the way the door opens. One group of doors is a clockwise-opening door, and the other group is a counterclockwise-opening door.

Two kinds of conventional latch assemblies in accordance with the prior art are used respectively with the different groups of doors mentioned above.

The two kinds of conventional latch assemblies are very similar in shape and appearance so a workman can easily mistakenly identify the latch assembly and install the incorrect latch assembly in a door.

To overcome the shortcomings, the present invention provides a reversible latch assembly to obviate the aforementioned problems.

SUMMARY OF THE INVENTION

The main objective of the invention is to provide a reversible latch assembly that can be used in either a clockwise-opening door or a counterclockwise-opening door.

The reversible latch assembly in accordance with the present invention has a faceplate assembly, a latch bolt assembly, a bolt-releasing assembly, a guardian bolt assembly, a driver assembly and a casing assembly.

The latch bolt assembly, the bolt-releasing assembly and the guardian bolt assembly are rotatably mounted inside the casing assembly and allow the latch assembly to be reversed and used in either a clockwise or counterclockwise opening door.

Other objectives, advantages and novel features of the invention will become more apparent from the following detailed description when taken in conjunction with the accompanying drawings.

DETAILED DESCRIPTION OF PREFERRED EMBODIMENT

Figure 1:
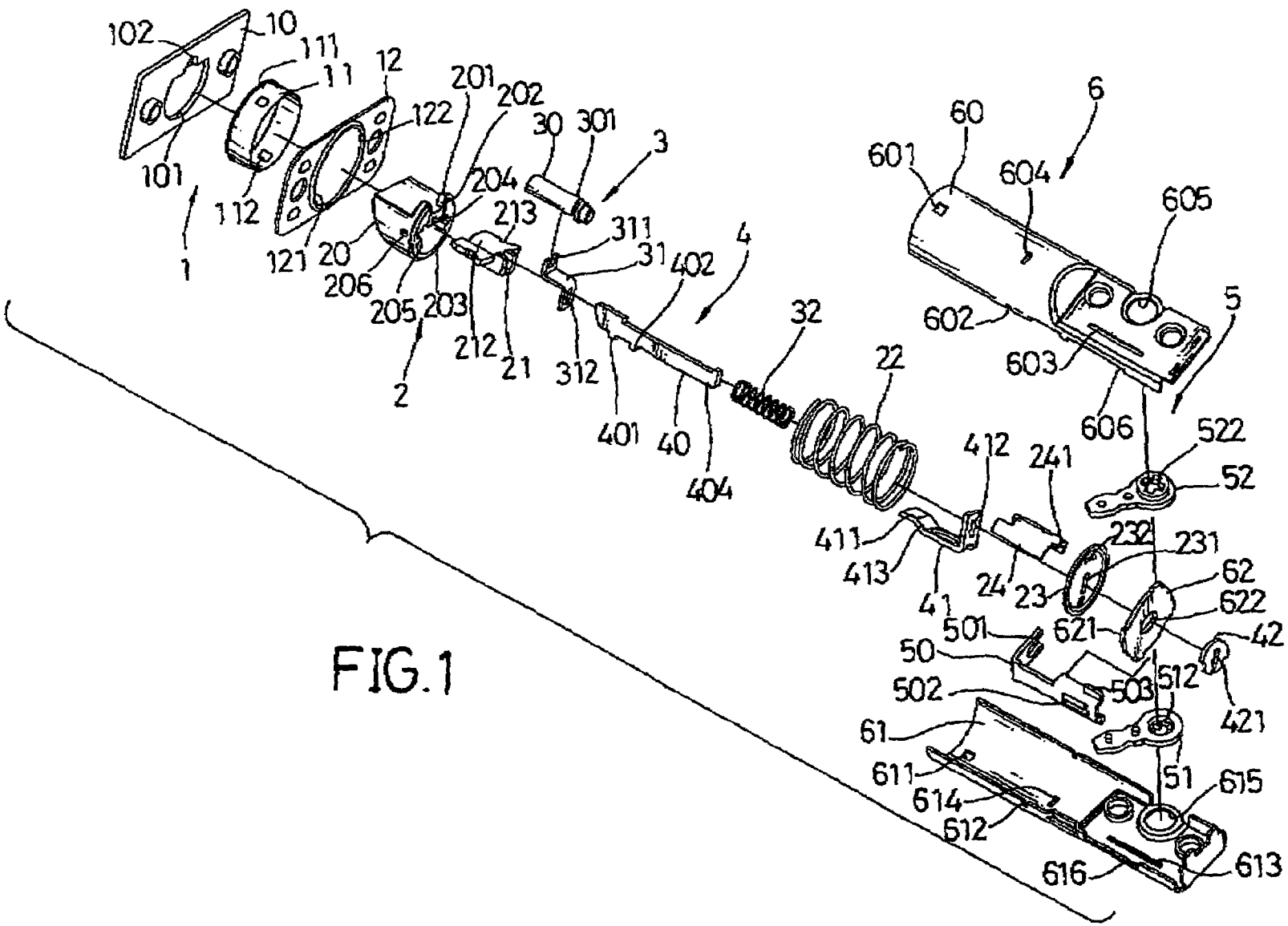
FIG. 1 is an exploded perspective view of a reversible latch assembly in accordance with the present invention.
Figure 3:
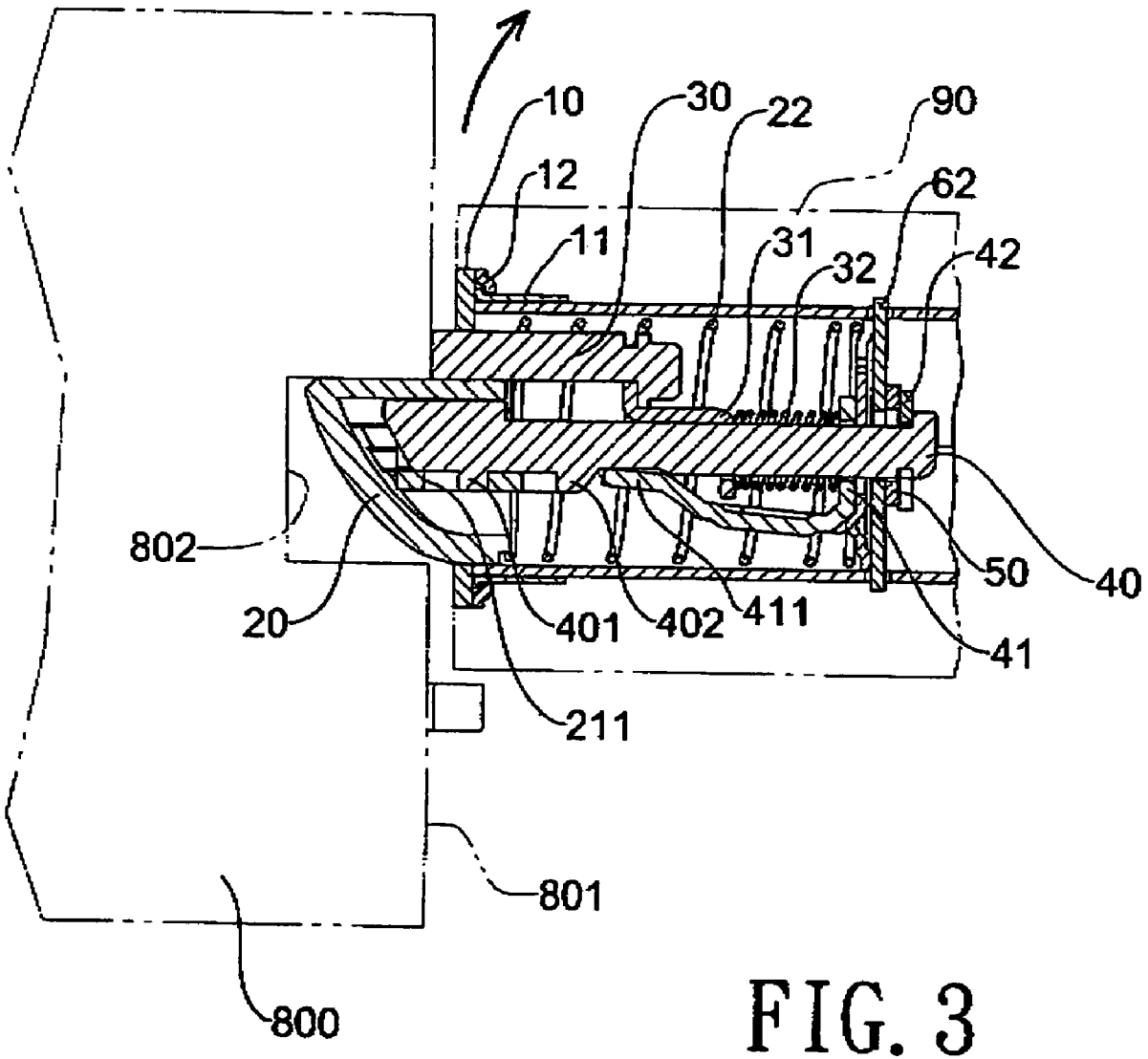
FIG. 3 is a top view in partial section of the reversible latch assembly in FIG. 2 mounted inside a clockwise-opening door and engaging a doorjamb.
Figure 12:
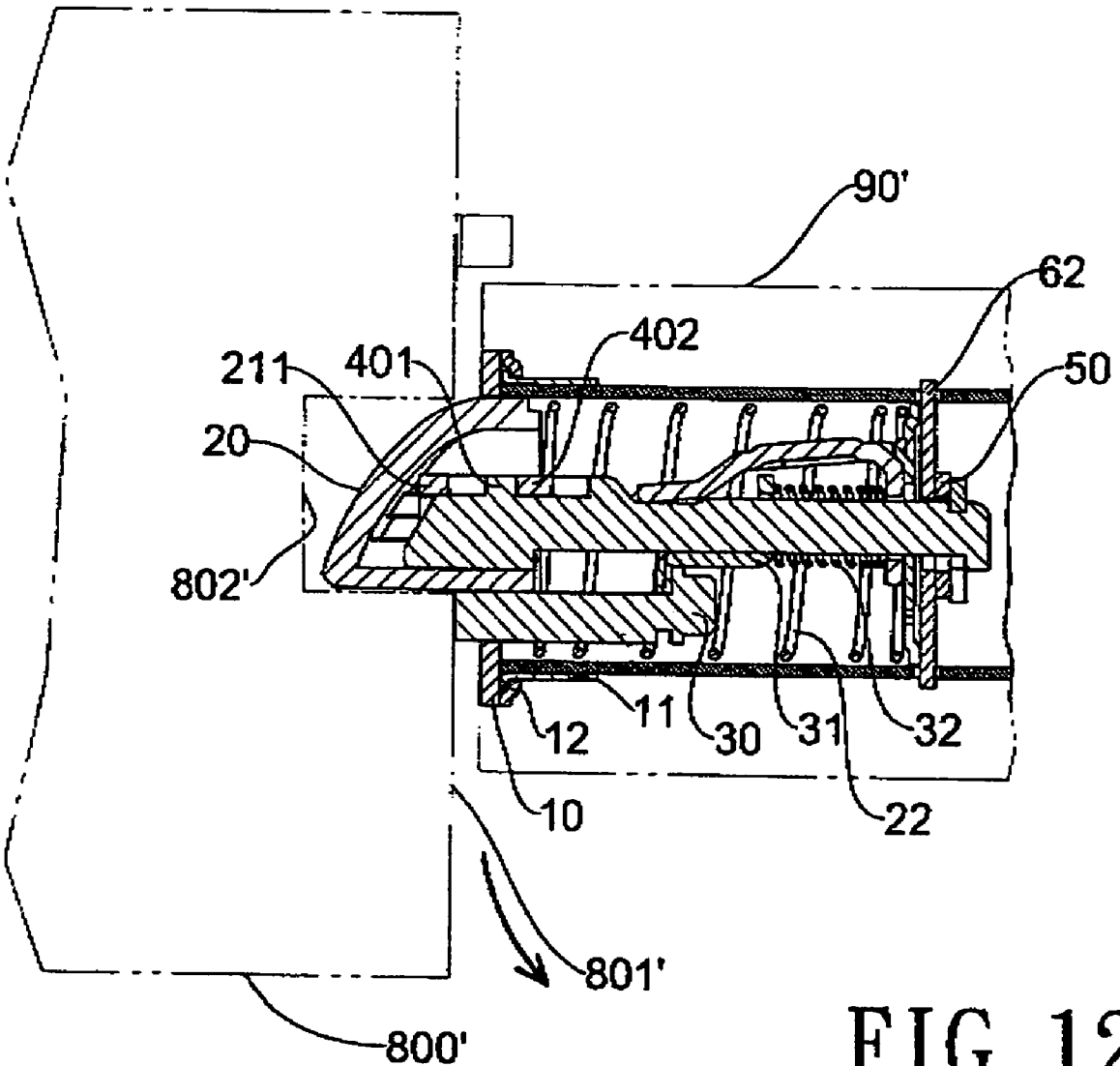
FIG. 12 is an operational top view in partial cross section of the reversible latch assembly in FIG. 2 when the reversible latch assembly is mounted inside a counterclockwise-opening door.

With reference to FIGS. 1, 3 and 12, a reversible latch assembly in accordance with the present invention can be mounted selectively in either a clockwise-opening door (90) or a counterclockwise-opening door (90') and comprises a faceplate assembly (1), a latch bolt assembly (2), a bolt-releasing assembly (4), a guardian bolt assembly (3), a driver assembly (5) and a casing assembly (6). The clockwise-opening door (90) or counterclockwise-opening door (90') is mounted in a doorframe (800, 800') that has two vertical doorjambs (801, 801') and a latch bolt hole (802, 802') defined in one of the doorjambs (801, 801'). The clockwise-opening door (90) and the counterclockwise-opening door (90') have a vertical proximal edge (not shown), a vertical distal edge and a rotatable door handle (not shown). The proximal edge is attached pivotally to the doorjamb (801, 801') opposite to the latch bolt hole (802, 802'). The distal edge corresponds to the doorjamb (801, 801') with the latch bolt hole (802, 802'). The rotatable door handle mounted on the door (90, 90') near the distal edge. The reversible latch assembly is mounted in the distal edge of the door (90, 90'), selectively engages with the latch bolt hole (802, 802') and is connected to and driven by the rotatable door handle.

Figure 2:
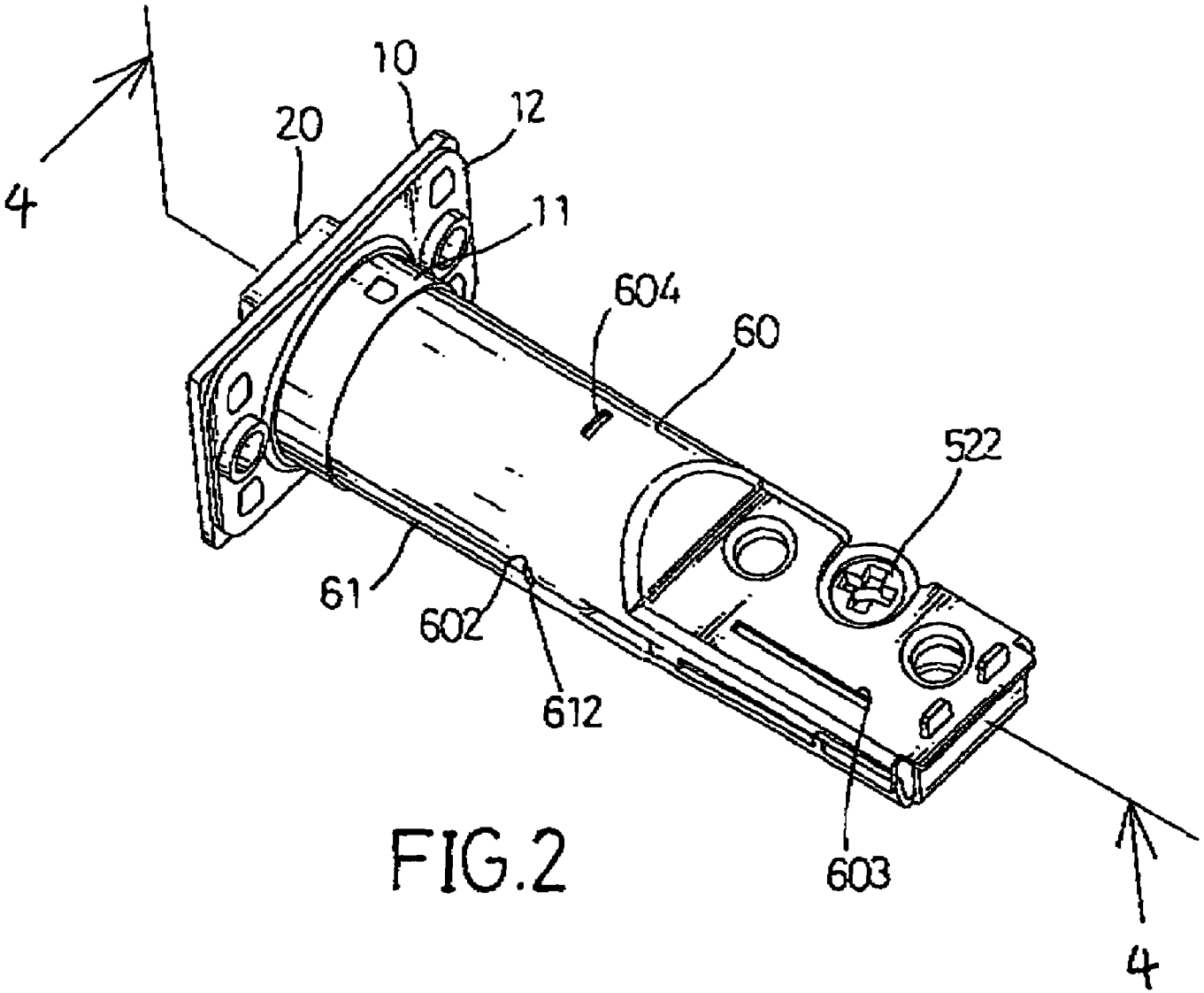
FIG. 2 is a perspective view of the reversible latch assembly in FIG. 1.
Figure 4:
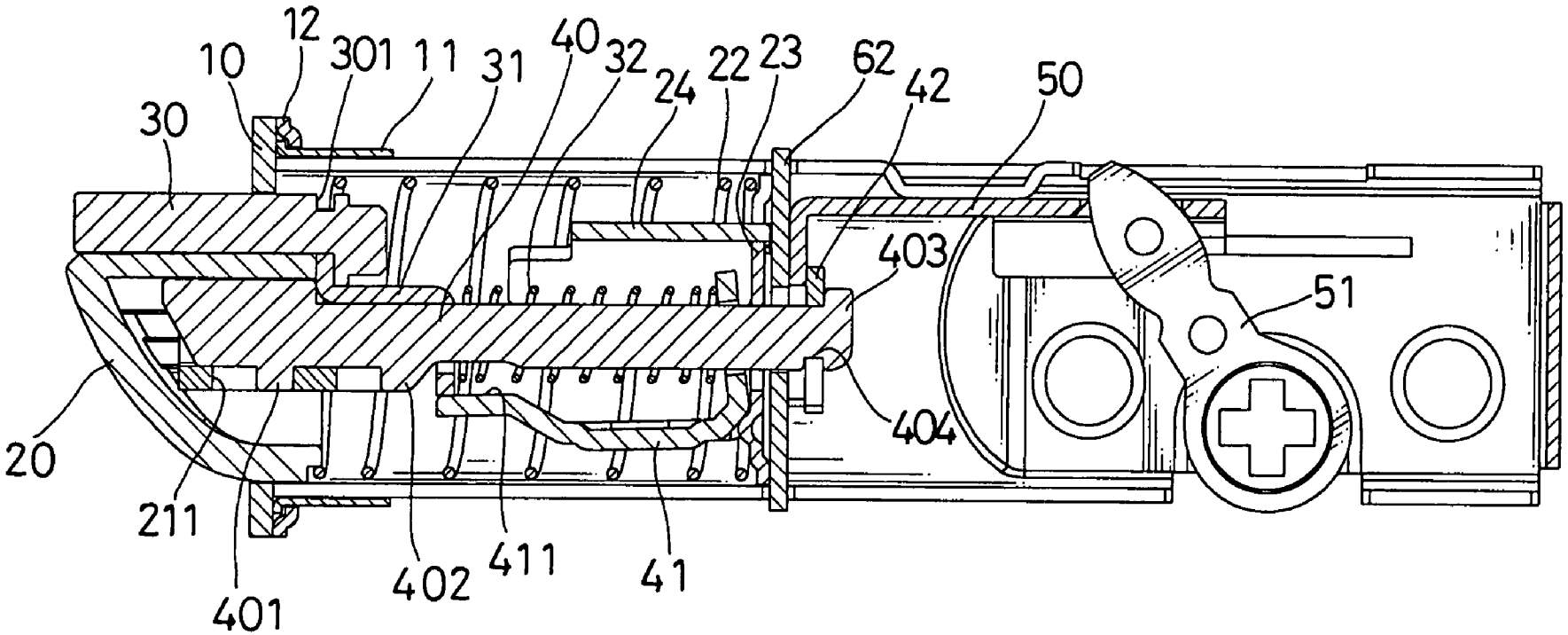
FIG. 4 is a top view in partial section of the reversible latch assembly 4—4 in FIG. 2 when the clockwise-opening door is open.
Figure 5:
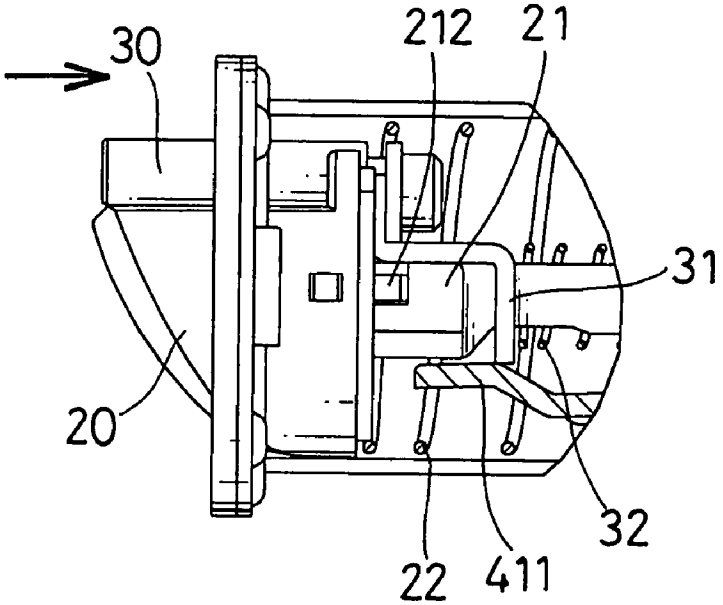
FIG. 5 is an enlarged top view in partial section of the reversible latch assembly in FIG. 4 when the bottom of the transverse foot of the guardian guide is between the longitudinal lip and the inclined connector of the locking tab.
Figure 6:
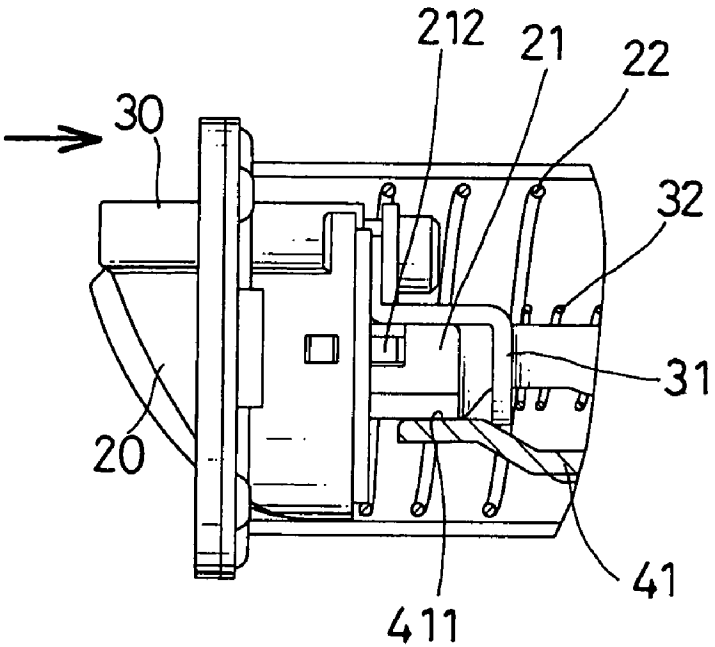
FIG. 6 is an enlarged top view in partial section of the reversible latch assembly in FIG. 4 when the bottom of the transverse foot of the guardian guide passes through the longitudinal lip and connects to the inclined connector of the locking tab.
Figure 7:
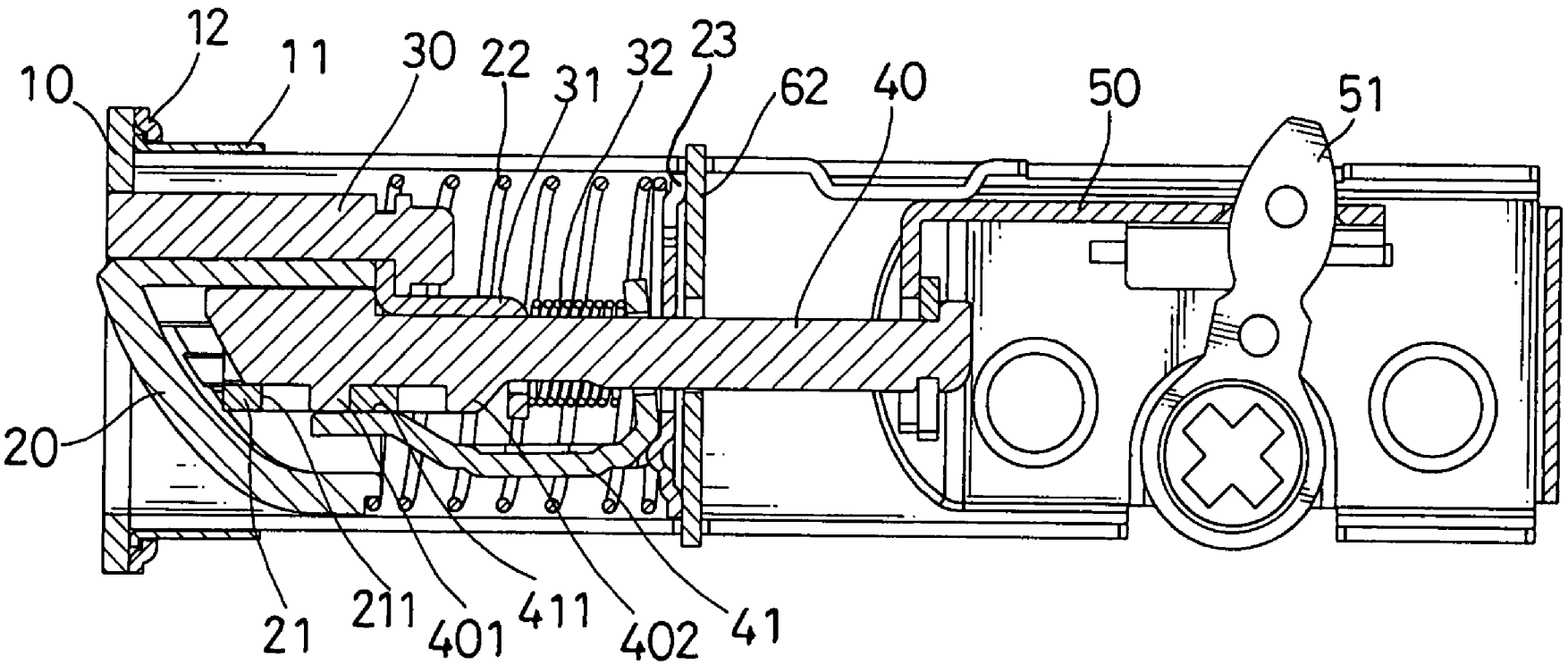
FIG. 7 is an operational top view in partial section of the reversible latch assembly 4—4 in FIG. 2 when the latch bolt and the guardian bolt are pulled completely inside the casing assembly.

With further reference to FIGS. 2 and 4, the faceplate assembly (1) has a faceplate (10), a tubular bushing (11) and a backing plate (12).

The faceplate (10) has a front, a back, a latch-bolt hole (101) and a guardian bolt hole (102). The latch-bolt hole (101) is defined through the faceplate (10). The guardian bolt hole (102) is defined through the faceplate (10) and communicates with the latch-bolt hole (101).

The tubular bushing (11) is connected to the back of the faceplate (10) and has an inner surface, an outer end, an inner end, a radial lip (111) and two casing connectors (112). The outer end of the tubular bushing (11) rotatably abuts the back of the faceplate (10). The radial lip (111) is defined on the outer end of the tubular bushing (11). The two casing connectors (112) are defined on and extend inward from the inner surface of the tubular bushing (11) opposite to each other.

The backing plate (12) is attached to the back of the faceplate (10) and rotatably holds the radial lip (111) on the tubular bushing (11) between the back of the faceplate (10) and the backing plate (12). The backing plate (12) has a front, a back, a central through hole (121) and an annular shoulder (122). The front of the backing plate (12) is connected to the back of the faceplate (10). The central through hole (121) is defined through the backing plate (12), and the tubular bushing (11) is mounted through the central through hole (121). The annular shoulder (122) is defined in the front of the backing plate (12) around the central through hole (121) and corresponds to and rotatably holds the radial lip (111) on the tubular bushing (11).

The latch bolt assembly (2) corresponds to the latch bolt hole (802) in the doorframe (800) and has a latch bolt (20), a latch bolt connector (21), a latch spring (22), a spring cap (23) and a curved cover (24).

The latch bolt (20) extends through the central through hole (121) in the backing plate (12), the tubular bushing (11) and the latch-bolt hole (101) in the faceplate (10) and has an outer end, an inner end, an inner edge, a flat top surface, an inclined surface, two edge extensions (201), an outer notch (202), an opening (203), an inner surface, an upper longitudinal groove (204), two longitudinal lateral grooves (205) and two fasteners (206). The inner edge is formed on the inner end and has an annular shoulder. The inclined surface is formed on the outer end of the latch bolt (20). The two edge extensions (201) are defined on the flat top surface at the inner end of the latch bolt (20) and extend from the inner edge to make the inner end essentially circular. The outer notch (202) is defined between the edge extensions (201). The opening (203) is defined in the inner end of the latch bolt (20). The inner surface is defined inside the opening (203) and has two sides and a top. The upper longitudinal groove (204) is defined in the top of the inner surface inside the opening (203). The longitudinal lateral grooves (205) are defined respectively in opposite sides of the inner surface inside the opening (203). The fasteners (206) are defined respectively on the sides of the inner surface inside the opening (203) and extend respectively into the longitudinal lateral grooves (205).

The latch bolt connector (21) is mounted inside the opening (203) in the inner end of the latch bolt (20) and has a bottom, a bottom longitudinal slot (211) and two wings (212). The bottom of the latch bolt connector (21) has two sides. The bottom longitudinal slot (211) is defined through the bottom of the latch bolt connector (21). The two wings (212) extend respectively from the sides of the latch bolt connector (21) and are mounted respectively in the longitudinal lateral grooves (205) in the latch bolt (20), and each wing (212) has a fastener notch (213) corresponding to and engaged by the fasteners (206) on the latch bolt (20).

The latch spring (22) has an outer end and an inner end. The outer end is mounted on the shoulder around the inner end of the latch bolt (20).

The spring cap (23) is connected to the inner end of the latch spring (22) and has a front, a back, a central slot (231) and an annular attachment slot (232). The central slot (231) and the annular attachment slot (232) are defined completely through the spring cap (23).

The curved cover (24) is attached to and extends forward from the front of the spring cap (23) and has an outer end, an inner end and a longitudinal tab (241). The outer end of the curved cover (24) is connected to the inner end of the latch bolt (20). The longitudinal tab (241) is defined at and extends longitudinally from the inner end of the curved cover (24) and is mounted in the annular attachment slot (232) in the spring cap (23).

The bolt-releasing assembly (4) is attached to the latch bolt (20) and has a shaft (40), a locking tab (41) and a clasp (42).

The shaft (40) is slidably mounted in the latch bolt connector (21), passes through the central slot (231) in the spring cap (23) and has a top, a bottom, an outer end, an inner end, a top hook (403), a bottom protrusion (401), a bottom notch (404) and an inclined protrusion (402). The outer end of the shaft (40) is mounted in the opening (203) in the latch bolt (20). The top hook (403) is defined at the inner end on the top of the shaft (40). The bottom protrusion (401) is defined close to the outer end on the bottom of the shaft (40) and is slidably mounted in the bottom longitudinal slot (211) in the latch bolt connector (21). The bottom notch (404) is defined at the inner end on the bottom of the shaft (40). The inclined protrusion (402) is defined between the bottom notch (404) and the bottom protrusion (401) on the bottom of the shaft (40) and has an inclined surface sloping toward the inner end of the shaft (40).

The locking tab (41) is slidably mounted on the shaft (40) and has a transverse foot, a longitudinal leg, an inclined connector (413) and a longitudinal lip (411). The transverse foot is slidably mounted on the shaft (40) and has a bottom and a locking hole (412). The locking hole (412) is defined through the transverse foot and selectively slides on the inner end of the shaft (40). The longitudinal leg extends from the bottom of the transverse foot and has an inner end toward the latch bolt (20). The inclined connector (413) extends from the inner end of the longitudinal leg and has an inner end close to the bottom of the shaft (40) toward the latch bolt (20). The longitudinal lip (411) extends from the inner end of the inclined connector (413) toward the latch bolt (20) and has a top surface.

The clasp (42) is mounted between the spring cap (23) and the top hook (403) of the shaft (40) to hold the spring cap (23) on the end of the latch spring (22) and has a clasp slot (421) and two ends engaging the bottom notch (404) in the shaft (40).

The guardian bolt assembly (3) abuts the doorjamb (801), is mounted on the shaft (40) and has a guardian spring (32), a guardian guide (31) and a guardian bolt (30).

The guardian spring (32) is mounted around the shaft (40) between the inclined protrusion (402) of the shaft (40) and the locking tab (41).

The guardian guide (31) is slidably mounted on the shaft (40) between the inclined protrusion (402) of the shaft (40) and the guardian spring (32) and has a transverse foot, a longitudinal leg, a transverse lip and a guide bolt notch (311). The transverse foot is slidably mounted on the shaft (40) between the locking tab (41) and the guardian spring (32) and has a top, a bottom and a guide hole (312) defined through the transverse foot and mounted slidably around the inner end of the shaft (40). The longitudinal leg extends from the top of the transverse foot and has an inner end toward the latch bolt (20). The transverse lip extends from the inner end of the longitudinal leg and has a top. The guide bolt notch (311) is defined in the top of the transverse lip.

The guardian bolt (30) extends through the guardian bolt hole (102) in the faceplate (10), slides on the flat top surface of the latch bolt (20), is connected to the transverse lip of the of the guardian guide (31) and has an outer end, an inner end and an annular groove (301). The outer end of the guardian bolt (30) extends from the guardian bolt hole (203) in the faceplate (10). The inner end of the guardian bolt (30) is attached to the top lip of the guardian guide (31). The annular groove (301) is defined around the inner end of the guardian bolt (30) and engages the guide bolt notch (311) in the transverse lip of the guardian guide (31).

The driver assembly (5) is connected to the shaft (40) of the bolt-releasing assembly (4) and has a drive link (50) and a driver.

The drive link (50) is connected to the shaft (40) and has a longitudinal link and a front transverse link. The longitudinal link has two sides, a front end, a rear end, a drive slot (502) and two guide wings (503). The drive slot (502) is defined through the longitudinal link close to the rear end of the longitudinal link. The guide wings (503) are defined respectively on the sides at the rear end of the longitudinal link. The front transverse link extends perpendicular from the front end of the longitudinal link toward the shaft (40) and has a transverse link notch (501) connected to the shaft (40) by the clasp (42).

The driver is segmented, is connected to and driven by the door handle, extends through the drive slot (502) in the drive link (50) and has a male drive lever (51) and a female drive lever (52).

The male drive lever (51) has a distal end, an outer surface, a bushing (512) and a non-circular drive hole. The distal end of the male drive lever (51) extends through the drive slot (502) in the drive link (50). The bushing (512) is defined on the outer surface of the male drive lever (51). The non-circular drive hole is defined inside the bushing (512) through the male drive lever (51).

The female drive lever (52) is attached to the male drive lever (51) and has a distal end, an outer surface, a bushing (522) and a non-circular drive hole. The distal end of the female drive lever (52) extends through the drive slot (502) in the drive link (50). The bushing (522) is defined on the outer surface of the female drive lever (52). The non-circular drive hole in the female drive lever (52) is defined inside the bushing (522) through the female drive lever (52) and is aligned with the non-circular drive hole in the male drive lever (51).

The casing assembly (6) is connected to the faceplate assembly (1), encloses and rotatably holds the latch bolt assembly (2), the bolt-releasing assembly (4) and the guardian bolt assembly (3), holds the drive assembly (5) and has a male half-casing (61), a female half-casing (60) and a stationary retaining disk (62).

The male half-casing (61) is attached to the tubular bushing (11) and has a top edge, a bottom edge, an outer end, an inner end, an inner surface, a front attachment hole (611), a drive lever pivot hole (615), two open transverse mounting slots (612), a transverse mounting slot (614), a drive link guide slot (613) and a drive lever clearance opening (616). The outer end of the male half-casing (61) is connected to the inner surface of the tubular bushing (11). The front attachment hole (611) is defined through the male half-casing (61) close to the outer end of the male half-casing (61) and connects to one of the casing connectors (112) in the tubular bushing (11) to connect the male half-casing (61) to the tubular bushing (11). The drive lever pivot hole (615) is defined through the male half-casing (61) close to the inner end of the male half-casing (61), rotatably holds the bushing (512) on the male drive lever (51) and allows the male drive lever (51) to pivot. The open transverse mounting slots (612) are defined respectively on the top edge and the bottom edge of the male half-casing (61). The transverse mounting slot (614) is defined through the male half-casing (61) between the open transverse mounting slots (612). The drive link guide slot (613) is defined longitudinally in the inner surface of the male half-casing (61), corresponds to the drive lever pivot hole (615) and slidably holds one of the guide wings (503) of the drive link (50). The drive lever clearance opening (616) is defined in the top edge of the male half-casing (61), corresponds to the drive link guide slot (613) and allows the distal end of the male drive lever (51) to penetrate and freely move in the drive lever clearance opening (616).

The female half-casing (60) mates with the male half-casing (61), is attached to the tubular bushing (11) and has a top edge, a bottom edge, an outer end, an inner end, an inner surface, a front attachment hole (601), a drive lever pivot hole (605), two open transverse mounting slots (602), a transverse mounting slots (604), a drive link guide slot (603) and a drive lever clearance opening (606). The outer end of the female half-casing (60) is rotatably engaged with the faceplate (10) and the backing plate (12) and is connected to the inner surface of the tubular bushing (11). The inner surface of the female half-casing (60) is connected to the female drive lever (52). The front attachment hole (601) is defined through the female half-casing (60) at the outer end of the female half-casing (60) and is held by one of the casing connectors (112) in the tubular bushing (11). The drive lever pivot hole (605) is defined through the female half-casing (60) close to the inner end of the female half-casing (60), rotatably holds the bushing (522) on the female drive lever (52) and allows the female drive lever (52) to pivot. The open transverse mounting slots (602) are defined respectively on the top edge and the bottom edge of the female half-casing (60) and correspond to and communicate with the open transverse mounting slots (612) in the male half-casing (61). The transverse mounting slot (604) is defined through the female half-casing (60) between the open transverse mounting slots (612). The drive link guide slot (603) is defined longitudinally in the inner surface of the female half-casing (60), corresponds to the drive lever pivot hole (605) and slidably holds one of the guide wings (503) of the drive link (50). The drive lever clearance opening (606) is defined in the top edge of the female half-casing (60), corresponds to the drive link guide slot (603) and allows the distal end of the female drive lever (52) to penetrate and freely move in the drive lever clearance opening (606).

The stationary retaining disk (62) is securely mounted between the male half-casing (61) and the female half-casing (60) and has an outer edge, four mounting tabs (621) and a circular through hole (622). The four mounting tabs (621) are defined uniformly on and protrude radially out from the outer edge of the stationary retaining disk (62) and are mounted respectively in the open transverse mounting slots (612, 602) and the transverse mounting slots (614, 604) in the male half-casing (61) and the female half-casing (60). The circular through hole (622) is defined through the stationary retaining disk (62) and is mounted around the inner end of the shaft (40).

With further reference to FIGS. 4 to 7, the latch bolt (20) and the guardian bolt (30) extend through the faceplate assembly (10) and the bottom of the transverse foot of the guardian guide (31) abuts the top surface of the longitudinal lip (411) of the locking tab (41) when either the clockwise-opening or counterclockwise-opening door (90, 90') is open. Rotating the door handle rotates the driver toward the inner ends of the half-casings (61, 60) inside the casing assembly (6). The driver pulls the drive link (50) toward the inner ends. The drive link (50) pulls the clasp (42) and the shaft (40) with the inclined protrusion (402) that abuts the guardian guide (31) and pulls the guardian guide (31) away from the faceplate (10). The bottom of the transverse foot of the guardian guide (31) slides on the longitudinal lip (411) and the inclined connector (413) of the locking tab (41). The guardian bolt (30) and the latch bolt (20) are pulled respectively by the guardian guide (31) and the latch bolt connector (21) into the casing assembly (6).

Figure 9:
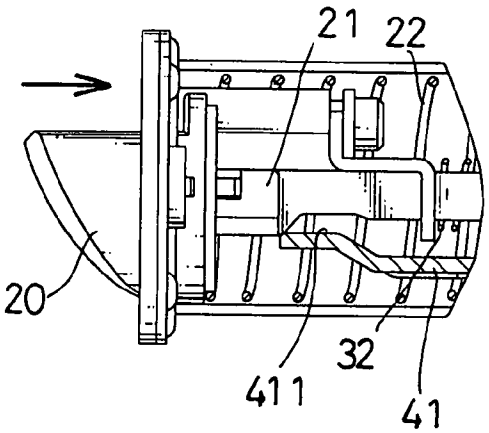
FIG. 9 is an enlarged top view in partial section of the reversible latch assembly in FIG. 8 when the latch bolt is moved by the rotating driver indirectly into the casing assembly.
Figure 8:
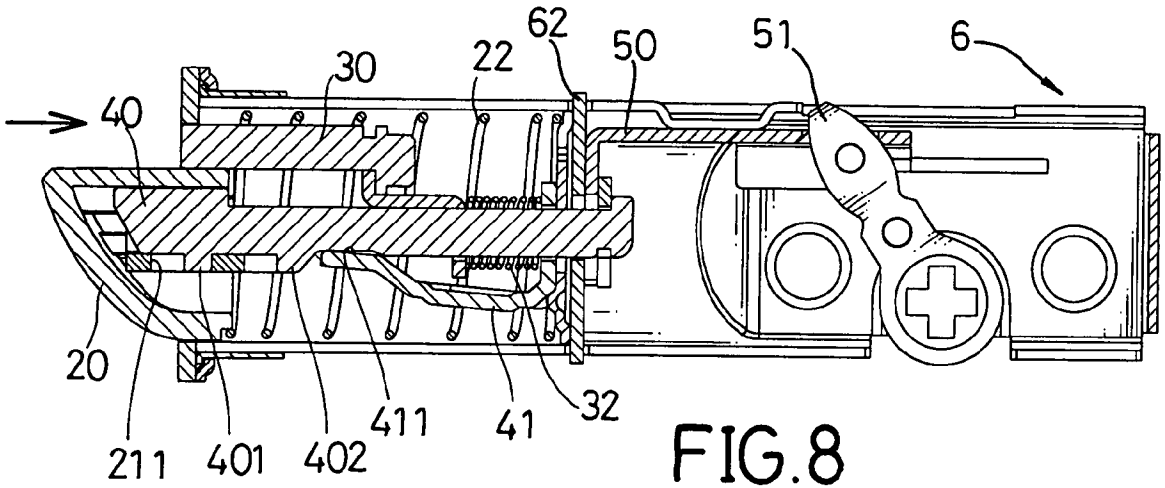
FIG. 8 is an operational top view in partial section of the reversible latch assembly along in FIG. 2 when the clockwise-opening door is closed and the latch bolt engages the latch bolt hole in the doorjamb.

With further reference to FIGS. 8 and 9, the guardian spring (32) pushes the guardian bolt (30) against the doorjamb (801) when the door (90, 90') is closed. The latch spring (22) pushes the latch bolt (20) into the latch bolt hole (802) in the doorframe (800). The longitudinal lip (411) of the locking tab (41) abuts the bottom of the shaft (40) adjacent to the inclined surface of the inclined protrusion (402). The closed door (90, 90') is opened by rotating the door handle that rotates the driver toward the inner ends of the half-casings (61, 60) inside the casing assembly (6). The driver pulls the drive link (50) toward the inner ends of the half-casings (61, 60). The drive link (50) pulls the clasp (42) and the shaft (40) with inclined protrusion (402) toward the inner ends of the casing (60, 61). As the shaft (40) is pulled, the longitudinal lip (411) slides down along the inclined surface of the inclined protrusion (402), the latch bolt (20) is pulled inside the casing assembly (6), and the door (90, 90') can be opened.

Figure 11:
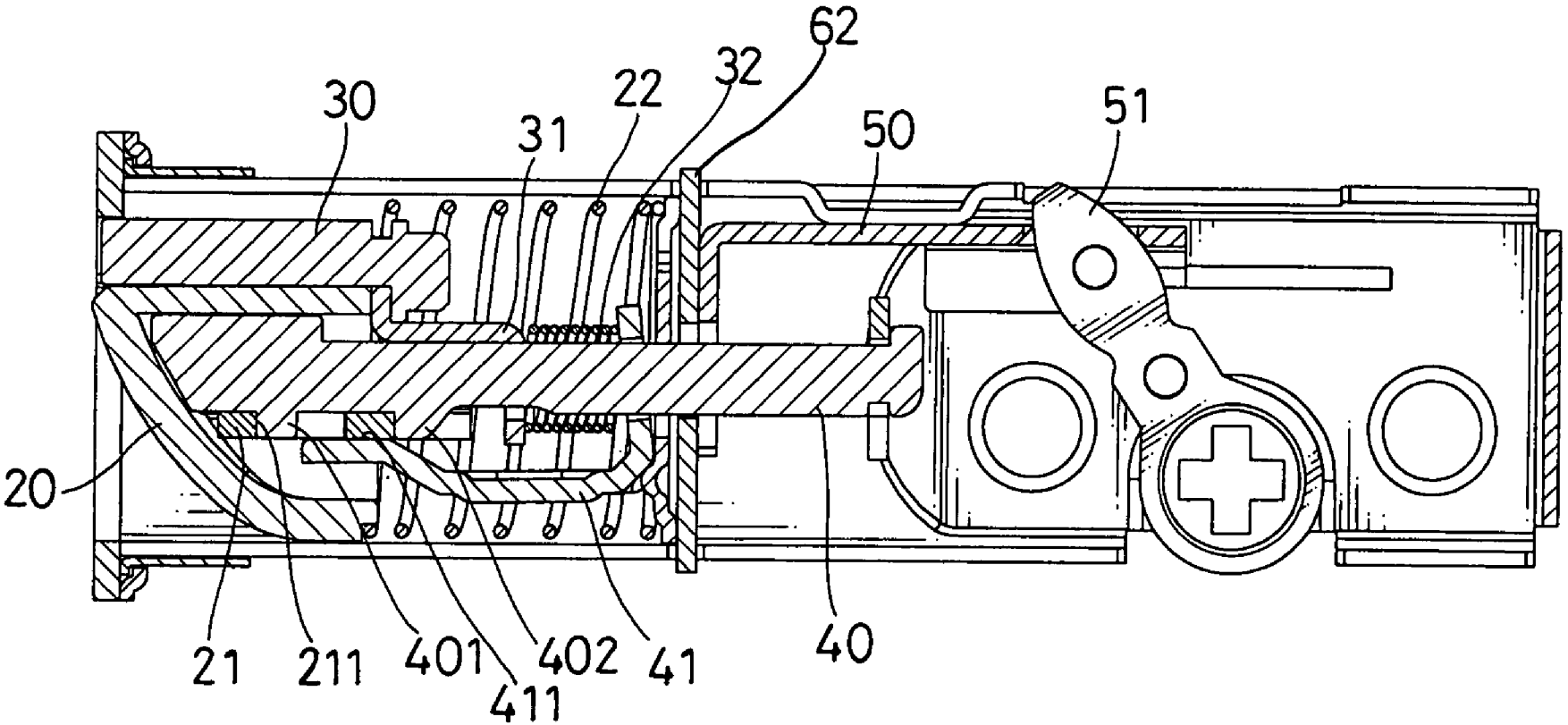
FIG. 11 is an operational top view in partial section of the reversible latch assembly 4—4 in FIG. 2 when the clockwise-opening door is closed without rotating the door handle.

With further reference to FIG. 11, the guardian guide (31) is pushed by the inner end of the latch bolt (20) and pulls the guardian bolt (30) into the casing assembly (6) when the latch bolt (20) is retracted into the casing assembly (6) by rotating the door handle.

Figure 10:
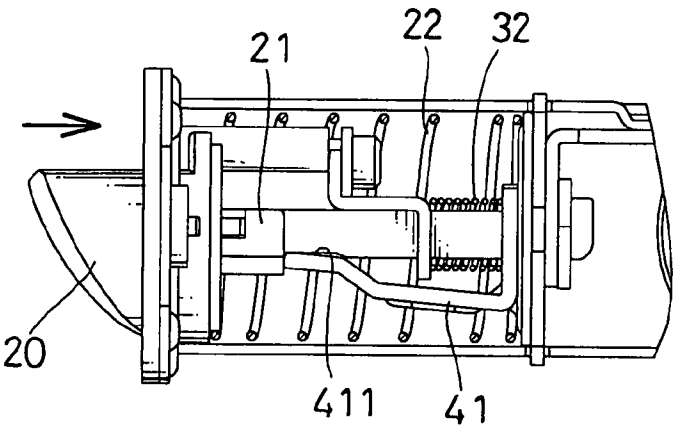
FIG. 10 is an enlarged top view in partial section of the reversible latch assembly in FIG. 3 when the latch bolt is pushed toward the casing assembly and the latch bolt connector abuts the longitudinal lip to keep the latch bolt from being pushed completely into the casing assembly.

With further reference to FIGS. 8 and 10, a person is kept from opening the door (90, 90') by manually pushing the latch bolt (20) into the casing assembly (6) by the latch bolt connector (21) abutting the longitudinal lip (411). When the latch bolt (20) is pushed into the casing assembly (6), the bottom longitudinal slot (211) in latch bolt connector (21) slides along the bottom protrusion (401) on the shaft (40) and abuts the longitudinal lip (411), thereby preventing any further inward movement of the latch bolt (20). Consequently, the latch bolt (20) cannot be manually disengaged from the latch bolt hole (802).

When mounting the reversible latch assembly into a counterclockwise-opening door (90'), the faceplate (10) and the backing plate (12) are rotated 180° on the tubular bushing (11). The latch bolt (20) and the guardian bolt (30) rotate with the faceplate (10) and rotate the latch bolt assembly (2), the guardian bolt assembly (3) and the bolt-releasing assembly (4) 180°. The reversible latch assembly in accordance with the present invention works inside the counterclockwise-opening door (90').

The reversible latch assembly in accordance with the present invention can be adapted quickly and easily for use with either a clockwise-opening door (90) or a counterclockwise-opening door (90') and is much more practical than the conventional latch assembly.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A reversible latch assembly for use in a door mounted pivotally in a doorframe, the reversible latch assembly comprising:

a faceplate assembly having a faceplate having a front;

a back;

a latch-bolt hole defined through the faceplate;

a guardian bolt hole defined through the faceplate communicating with the latch-bolt hole;

a tubular hushing connected to the back of the faceplate and having an inner surface;

an outer end rotatably abutting the back of the faceplate;

an inner end; and a radial lip formed on the outer end of the tubular bushing;

a backing plate attached to the back of the faceplate, rotatably holding the radial lip on the tubular bushing between the back of the faceplate and the backing plate and having a front connected to the back of the faceplate;

a back;

a central through hole defined through the backing plate in which the tubular bushing is mounted; and an annular shoulder defined in the front of the backing plate around the central through hole and corresponding to and rotatably holding the radial lip on the tubular bushing; and two casing connectors defined on and extending inward from the inner surface of the tubular bushing opposite to each other;

a latch bolt assembly corresponding to the latch bolt hole in the faceplate and having a latch bolt extending through the central through hole in the backing plate, the tubular bushing and the latch-bolt hole in the faceplate and having an outer end;

an inner end;

an inner edge formed on the inner end and having an annular shoulder;

an inclined surface formed on the outer end of the latch bolt;

a flat top surface;

two edge extensions defined on the flat tap surface at the inner end of the latch bolt and extending from the inner edge to make the inner end essentially circular;

an outer notch defined between the edge extensions;

an opening defined in the inner end of the latch bolt;

an inner surface defined inside the opening and having two sides and a top;

an upper longitudinal groove defined in the top of the inner surface inside the opening;

two longitudinal lateral grooves defined respectively in opposite sides of the inner surface inside the opening; and two fasteners defined respectively on the sides of the inner surface inside the opening and extending respectively into the longitudinal lateral grooves;

a latch bolt connector mounted inside the opening in the inner end of the latch bolt and having a bottom having two sides;

a bottom longitudinal slot defined through the bottom of the latch bolt connector; and two wings extending respectively from the sides of the latch bolt connector and mounted respectively in the longitudinal lateral grooves in the latch bolt, and each wing having a fastener notch corresponding to and engaged by one of the fasteners in the latch bolt;

a latch spring having an outer end mounted on the shoulder around the inner end of the latch bolt; and an inner end;

a spring cap connected to the inner end of the latch spring and having a front, a back, a central slot defined completely through the spring cap and an annular attachment slot defined completely through the spring cap; and a curved cover attached to and extending forward from the front of the spring cap and having an outer end connected to the inner end of the latch bolt;

an inner end; and a longitudinal tab defined at and extending longitudinally from the inner end of the curved cover and mounted in the annular attachment slot in the spring cap;

a bolt-releasing assembly attached to the latch bolt and having a shaft slidably mounted in the latch bolt connector, passing through the central slot in the spring cap and having an outer end mounted in the opening in the latch bolt and an inner end;

a locking tab slidably mounted on the shaft; and a clasp mounted to the inner end of the shaft;

a guardian bolt assembly mounted on the shaft and having a guardian spring mounted around the shaft;

a guardian guide slidably mounted on the shaft; and a guardian bolt extending through the guardian bolt hole in the faceplate, sliding, on the flat top surface of the latch bolt and connected to the guardian guide;

a driver assembly connected to the shaft of the bolt-releasing assembly and having a drive link connected to the shaft and having a longitudinal link having two sides;

a front end;

a rear end;

a drive slot defined through the longitudinal link close to the rear end of the longitudinal link; and two guide wings defined respectively on the sides at the rear end of the longitudinal link; and a front transverse link extending perpendicular from the front end of the longitudinal link toward the shaft having a transverse link notch connected to the shaft by the clasp; and a segmented driver extending through the drive slot in the drive link; and a casing assembly connected to the faceplate assembly, enclosing and rotatably holding the latch bolt assembly, the bolt-releasing assembly and the guardian bolt assembly, holding the drive assembly and having a male half-casing attached to the tubular bushing;

a female half-casing treating with the male half-casing, attached to the tubular bushing; and a stationary retaining disk securely mounted between the male half-casing and the female half-casing and having an outer edge; and a circular through hole defined through the stationary retaining disk and mounted around the inner end of the shaft.

2. The reversible latch assembly as claimed in claim 1, wherein the shaft of the bolt-releasing assembly further has a top;

a bottom;

a top hook defined at the inner end on the top of the shaft;

a bottom protrusion defined close to the outer end on the bottom of the shaft and slidably mounted in the bottom longitudinal slot in the latch bolt connector;

a bottom notch defined at the inner end on the bottom of the shaft; and an inclined protrusion defined between the bottom notch and the bottom protrusion on the bottom of the shaft and having an inclined surface sloping toward the inner end of the shaft;

the looking tab of the bolt-releasing assembly further has a transverse foot slidably mounted on the shaft and having a bottom and a locking hole defined through the transverse foot and selectively sliding on the inner end of the shaft;

a longitudinal leg extending from the bottom of the transverse foot and having an inner end toward the latch bolt;

an inclined connector extending from the inner end of the longitudinal leg and having an inner end close to the bottom of the shaft toward the latch bolt; and a longitudinal lip extending from the inner end of the inclined connector toward the latch bolt and having a top surface; and the clasp of the bolt-releasing assembly is mounted between the spring cap and the top hook of the shaft to hold the spring cap on the inner end of the latch spring and has a clasp slot and two ends engaging the bottom notch in the shaft.

3. The reversible latch assembly as claimed in claim 2, wherein the guardian spring of the guardian bolt assembly is mounted between the inclined protrusion of the shaft and the locking tab;

the guardian guide of the guardian bolt assembly is mounted between the inclined protrusion of the shaft and the guardian spring and further has a transverse foot slidably mounted on the shaft between the locking tab and the guardian spring and having a top, a bottom and a guide hole defined through the transverse foot and mounted slidably around the inner end of the shaft;

a longitudinal leg extending from the top of the transverse foot and having an inner end toward the latch bolt;

a transverse lip extending from the inner end of the longitudinal leg and having a top; and a guide bolt notch defined in the top of the transverse lip;

the guardian bolt of the guardian bolt assembly is connected to the transverse lip of the of the guardian guide and further has an outer end extending from the guardian bolt hole in the face plate;

an inner end attached to the transverse lip of the guardian guide; and an annular groove defined around the inner end of the guardian bolt and engaging the guide bolt notch in the transverse lip of the guardian guide.

4. The reversible latch assembly as claimed in claim 3, wherein the segmented driver of the driver assembly further has a male drive lever having a distal end extending through the drive slot in the drive link;

an outer surface;

a bushing defined on the outer surface of the male drive lever; and a non-circular drive hole defined inside the bushing through the male drive lever; and a female drive lever attached to the male drive lever and having a distal end extending through the drive slot in the drive link;

an outer surface;

a bushing defined on the outer surface of the female drive lever; and a non-circular drive hole defined inside the bushing through the female drive lever and aligned with the non-circular drive hole in the male drive lever.

5. The reversible latch assembly as claimed in claim 4, wherein:

the male half-casing of the casing assembly further has a top edge;

a bottom edge;

an outer end connected to the inner surface of the tubular bushing;

an inner end;

an inner surface;

a front attachment hole defined through the male half-casing close to the outer end of the male half-casing and connecting to one of the casing connectors in the tubular bushing to connect the male half-casing to the tubular bushing;

a drive lever pivot hole defined through the male half-casing close to the inner end of the male half-casing, rotatably holding the bushing on the male drive lever and allowing the male drive lever to pivot;

two male half-casing open transverse mounting slots defined respectively on the top edge and the bottom edge of the male half-casing;

a transverse mounting slot defined through the male half-casing between the male half-casing open transverse mounting slots;

a drive link guide slot defined longitudinally in the inner surface of the male half-casing, corresponding to the drive lever pivot hole and slidably holding one of the guide wings of the drive link; and a drive lever clearance opening defined in the top edge of the male half-casing, corresponding to the drive link guide slot and allowing the distal end of the male drive lever to penetrate and freely move in the drive lever clearance opening;

the female half-casing of the casing assembly further has a top edge;

a bottom edge;

an outer end rotatably engaged with the faceplate and the backing plate and connected to the inner surface of the tubular bushing;

an inner end;

an inner surface connected to the female drive lever;

a front attachment hole defined through the female half-casing at the outer end of the female half-using and held by one of the casing connectors in the tubular bushing, a drive lever pivot hole defined through the female half-casing close to the inner end of the female half-casing, rotatably holding the bushing on the female drive lever and allowing the female drive lever to pivot;

two female half-casing open transverse mounting slots defined respectively on the top edge and the bottom edge of the female half-casing and corresponding to and communicating with the open transverse mounting slots in the male half-casing;

a transverse mounting slot defined through the female half-casing between the female half-casing open transverse mounting slots;

a drive link guide slot defined longitudinally in the inner surface of the female half-casing, corresponding to the drive lever pivot hole and slidably holding one of the guide wings of the drive link; and a drive lever clearance opening defined in the top edge of the female half-casing, corresponding to the drive link guide slot and allowing the distal end of the female drive lever to penetrate and freely move in the drive lever clearance opening; and the stationary retaining disk of the casing assembly further has four mounting tabs defined uniformly on and protruding radially out from the outer edge of the stationary retaining disk and mounted respectively in the open transverse mounting slots and the transverse mounting slots in the male half-casing and the female half-casing.

* * * * *